US008820436B2

(12) United States Patent
Reid, Jr. et al.

(10) Patent No.: US 8,820,436 B2
(45) **Date of Patent: *Sep. 2, 2014**

(54) CORING TOOL AND METHOD

(71) Applicant: Schlumberger Technology Corporation, Sugar Land, TX (US)

(72) Inventors: Lennox E. Reid, Jr., Houston, TX (US); Rachel Agnes Lavaure, Tokyo (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/852,550

(22) Filed: Mar. 28, 2013

(65) Prior Publication Data

US 2013/0213712 A1 Aug. 22, 2013

Related U.S. Application Data

(63) Continuation of application No. 13/301,371, filed on Nov. 21, 2011, now Pat. No. 8,408,332, which is a continuation of application No. 11/934,103, filed on Nov. 2, 2007, now Pat. No. 8,061,446.

(51) Int. Cl.
*E21B 49/06* (2006.01)
*E21B 25/00* (2006.01)

(52) U.S. Cl.
USPC ..... 175/40; 175/20; 175/77; 175/78

(58) Field of Classification Search
CPC ..... E21B 25/00; E21B 49/06
USPC ..... 175/20, 77, 78, 140, 38, 40, 99
See application file for complete search history.

(56) References Cited

U.S. PATENT DOCUMENTS

| | | | |
|---|---|---|---|
| 2,372,875 | A | 4/1945 | Benke |
| 2,546,670 | A | 3/1951 | Kirby |
| 3,430,716 | A | 3/1969 | Urbanosky |
| 3,677,081 | A | 7/1972 | Newton et al. |
| 4,461,360 | A | 7/1984 | Mount |
| 4,629,011 | A | 12/1986 | Reinhardt |
| 4,714,119 | A | 12/1987 | Hebert et al. |
| 4,860,581 | A | 8/1989 | Zimmerman et al. |
| 4,936,139 | A | 6/1990 | Zimmerman et al. |
| 5,115,872 | A | 5/1992 | Brunet et al. |
| 5,411,106 | A | 5/1995 | Maissa et al. |
| 5,439,065 | A | 8/1995 | Georgi |
| 5,617,927 | A | 4/1997 | Maissa |
| 5,667,025 | A | 9/1997 | Haessly et al. |
| 6,006,844 | A | 12/1999 | Van Puymbroeck et al. |

(Continued)

FOREIGN PATENT DOCUMENTS

| | | | |
|---|---|---|---|
| DE | 1484592 | A1 | 5/1969 |
| WO | 2005086699 | A2 | 9/2005 |

*Primary Examiner* — James Sayre
(74) *Attorney, Agent, or Firm* — Cathy Hewitt

(57) ABSTRACT

A method for operating a coring tool includes moving a handling piston of a coring tool from a first position to a second position with respect to the coring tool where the handling piston moving through a coring bit to the second position. The method also includes measuring the distance of the movement of the handling piston between the first position and the second position to determine a core length, comparing the measured distance with a predetermined threshold, and operating a coring bit of the coring tool to obtain a core sample in response to determining that the measured distance is less than the predetermined threshold.

20 Claims, 7 Drawing Sheets

(56) References Cited

U.S. PATENT DOCUMENTS

| | | | |
|---|---|---|---|
| 6,371,221 | B1 | 4/2002 | Harrigan et al. |
| 6,672,407 | B2 | 1/2004 | Streich |
| 7,191,831 | B2 | 3/2007 | Reid et al. |
| 7,293,715 | B2 | 11/2007 | Bargach et al. |
| 7,303,011 | B2 | 12/2007 | Reid et al. |
| 8,061,446 | B2 | 11/2011 | Reid, Jr. et al. |
| 2004/0140126 | A1 | 7/2004 | Hill et al. |
| 2005/0133267 | A1 | 6/2005 | Reid et al. |
| 2005/0284629 | A1 | 12/2005 | Reid et al. |
| 2006/0081398 | A1 | 4/2006 | Arian et al. |
| 2007/0045005 | A1 | 3/2007 | Tchakarov et al. |
| 2007/0137894 | A1 | 6/2007 | Fujisawa et al. |
| 2008/0236383 | A1 | 10/2008 | Matsumoto et al. |
| 2008/0314649 | A1 | 12/2008 | Hansen |

CORING TOOL AND METHOD

CROSS-REFERENCE TO RELATED APPLICATIONS

This application is a continuation of and claims priority to U.S. patent application Ser. No. 13/301,371, now U.S. Pat. No. 8,408,332, filed Nov. 21, 2011, which is a continuation of U.S. patent application Ser. No. 11/934,103, now U.S. Pat. No. 8,061,446, filed Nov. 2, 2007, the entire disclosures of which are hereby incorporated herein by reference in their entirety.

BACKGROUND

1. Technical Field

This disclosure generally relates to oil and gas well drilling and the subsequent investigation of subterranean formations surrounding the well. More particularly, this disclosure relates to apparatus and methods for obtaining and handling sample cores from a subterranean formation.

2. Description of the Related Art

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

Once a formation of interest is reached, drillers often investigate the formation and its contents through the use of downhole formation evaluation tools. Some types of formation evaluation tools form part of the drill string and are used during the drilling process. These are called, for example, "logging-while-drilling" ("LWD") tools or "measurement-while-drilling" ("MWD") tools. MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms. Furthermore, LWD and MWD are not necessarily performed while the drill bit is actually cutting through the formation. For example, LWD and MWD may occur during interruptions in the drilling process, such as when the drill bit is briefly stopped to take measurements, after which drilling resumes. Measurements taken during intermittent breaks in drilling are still considered to be made "while-drilling" because they do not require the drill string to be removed from the wellbore, or "tripped."

Other formation evaluation tools are used sometime after the well has been drilled. Typically, these tools are lowered into a well using a wireline for electronic communication and power transmission, and therefore are commonly referred to as "wireline" tools. In general, a wireline tool is lowered into a well so that it can measure formation properties at desired depths.

One type of wireline tool is called a "formation testing tool." The term "formation testing tool" is used to describe a formation evaluation tool that is able to draw fluid from the formation into the downhole tool. In practice, a formation testing tool may involve many formation evaluation functions, such as the ability to take measurements (i.e., fluid pressure and temperature), process data and/or take and store samples of the formation fluid. Thus, in this disclosure, the term formation testing tool encompasses a downhole tool that draws fluid from a formation into the downhole tool for evaluation, whether or not the tool stores samples. Examples of formation testing tools are shown and described in U.S. Pat. Nos. 4,860,581 and 4,936,139, both assigned to the assignee of the present application.

During formation testing operations, downhole fluid is typically drawn into the downhole tool and measured, analyzed, captured and/or released. In cases where fluid (usually formation fluid) is captured, sometimes referred to as "fluid sampling," fluid is typically drawn into a sample chamber and transported to the surface for further analysis (often at a laboratory). As fluid is drawn into the tool, various measurements of downhole fluids are typically performed to determine formation properties and conditions, such as the fluid pressure in the formation, the permeability of the formation and the bubble point of the formation fluid. The permeability refers to the flow potential of the formation. A high permeability corresponds to a low resistance to fluid flow. The bubble point refers to the fluid pressure at which dissolved gasses will bubble out of the formation fluid. These and other properties may be important in making exploitation decisions for example.

Another downhole tool typically deployed into a wellbore via a wireline is called a "coring tool." Unlike the formation testing tools, which are used primarily to collect sample fluids, a coring tool is used to obtain a sample of the formation rock.

A typical coring tool includes a hollow drill bit, called a "coring bit," that is advanced into the formation wall so that a sample, called a "core sample," may be removed from the formation. A core sample may then be transported to the surface, where it may be analyzed to assess, among other things, the reservoir storage capacity (called porosity) and permeability of the material that makes up the formation; the chemical and mineral composition of the fluids and mineral deposits contained in the pores of the formation; and/or the irreducible water content of the formation material. The information obtained from analysis of a core sample may also be used to make exploitation decisions amongst others.

Downhole coring operations generally fall into two categories: axial and sidewall coring. "Axial coring," or conventional coring, involves applying an axial force to advance a coring bit into the bottom of the well. Typically, this is done after the drill string has been removed, or "tripped," from the wellbore, and a rotary coring bit with a hollow interior for receiving the core sample is lowered into the well on the end of the drill string. An example of an axial coring tool is depicted in U.S. Pat. No. 6,006,844, assigned to Baker Hughes.

By contrast, in "sidewall coring," the coring bit is extended radially from the downhole tool and advanced through the side wall of a drilled borehole. In sidewall coring, the drill string typically cannot be used to rotate the coring bit, nor can it provide the weight required to drive the bit into the formation. Instead, the coring tool itself must generate both the torque that causes the rotary motion of the coring bit and the axial force, called weight-on-bit ("WOB"), necessary to drive the coring bit into the formation. Another challenge of sidewall coring relates to the dimensional limitations of the borehole. The available space is limited by the diameter of the borehole. There must be enough space to house the devices to operate the coring bit and enough space to withdraw and store a core sample. A typical sidewall core sample is about 1.5 inches (about.3.8 cm) in diameter and less than 3 inches long (.about.7.6 cm), although the sizes may vary with the size of the borehole. Examples of sidewall coring tools are shown and described in U.S. Pat. Nos. 4,714,119 and 5,667,025, both assigned to the assignee of the present application.

Sidewall coring tools face several challenges. In order to store multiple core samples, the coring bit is often pivotably mounted within the tool so that it can move between a coring position, in which the bit is positioned to engage the formation, and an eject position, in which a core sample may be ejected from the bit into a core sample receptacle. The known mechanisms for actuating the coring bit, however, are overly complicated and sensitive to the rough environment in which they are used. For example, U.S. Pat. No. 5,439,065 to Georgi discloses a sidewall coring apparatus having a bit box with hinge pins that are received in guide slots formed in plates. The guide slots are shaped to both rotate the coring bit and to extend it into the formation. In this example, the slots are susceptible to obstruction from solid material such as rocks or other debris that may enter the tool, and the WOB will vary as the bit is extended into the formation.

Additionally, sidewall coring tools have limited storage area for core samples. The '065 patent shows a receptacle that allows for a single column of core samples to be stored in the tool. Still further, conventional coring tools do not reliably break the core samples away from the formation.

SUMMARY OF THE DISCLOSURE

According to certain aspects of this disclosure, a coring tool for use in a borehole formed in a subterranean formation is provided having a tool housing adapted for suspension within the borehole at a selected depth. A coring aperture is formed in the tool housing and a core receptacle is disposed in the tool housing. A bit housing disposed within the tool housing and a coring bit is mounted within the bit housing and includes a cutting end. A bit motor is operably coupled to the coring bit and adapted to rotate the coring bit. A series of pivotably connected extension link arms have a first end pivotably coupled to the bit housing and a second end to move the coring bit between retracted and extended positions. An actuator is operably coupled to the second end of the series of extension link arms and adapted to actuate the coring bit between the retracted and extended positions.

According to another aspect, a coring tool for use in a borehole having a nominal diameter between 6.5 and 17.5 inches formed in a subterranean formation is provided having a tool housing adapted for suspension within the borehole, a coring aperture formed in the tool housing, and a core receptacle disposed in the tool housing. A bit housing is disposed within the tool housing and is pivotably coupled to the tool housing between an eject position, in which the coring bit registers with the core receptacle, and a coring position, in which the coring bit registers with the tool housing coring aperture. A coring bit is mounted within the bit housing and includes a cutting end. A bit motor is operably coupled to the coring bit and adapted to rotate the coring bit. An actuator is operably coupled to the bit and adapted to actuate the coring bit from a retracted position to an extended position, in which the distance between the retracted and extended positions is at least 2.25 inches.

According to additional aspects, a core storage assembly for a coring tool having a bit housing carrying a coring bit is provided which includes a core receptacle having at least first and second storage columns and a proximal end positioned nearer to the bit housing and a distal end positioned farther from the bit housing. A proximal shifter is disposed adjacent the receptacle proximal end and is movable between a first position, in which the proximal shifter registers with a proximal end of the first storage column, and a second position, in which the proximal shifter registers with a proximal end of the second storage column. A first transporter is positioned coaxial with the first storage column and is adapted to transport a core from the coring bit to the proximal shifter.

According to further aspects, a method of handling multiple cores in a coring tool for use in a borehole formed in a subterranean formation is provided that includes providing a coring bit assembly and providing a receptacle having first and second storage columns. The second storage column houses a series of stacked core holders. The method further includes registering at least one core holder with the coring bit and capturing a current core in the at least core holder. The current core is then transported into the first storage column.

According to still further aspects, a method of handling a sample core in a coring tool for use in a borehole formed in a subterranean formation is provided in which a handling piston is extended to a first position in which the handling piston engages a first core holder. A first distance is measured that corresponds to the first position of the handling piston. The sample core is captured and the handling piston is extended to a second position, thereby to advance the core. A second distance corresponding to the second position of the handling piston is measured, a length of the first core is determined from the first and second distances, and the core length is displayed.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

This disclosure relates to apparatus and methods for obtaining core samples from subterranean formations. In some embodiments, a sidewall coring tool includes a coring bit that is moveable between eject and coring positions using link arms. In other embodiments, the sidewall coring tool includes a storage area capable of handling and storing cores in multiple storage columns. In related embodiments, a transfer mechanism is provided for transporting the cores between the coring bit and the storage area. In still other embodiments, the sidewall coring tool may further rotate the coring bit to a sever position to assist with breaking the core sample from the formation. The apparatus and methods disclosed herein may be used in both "wireline" and "while-drilling" applications.

Figure 1:
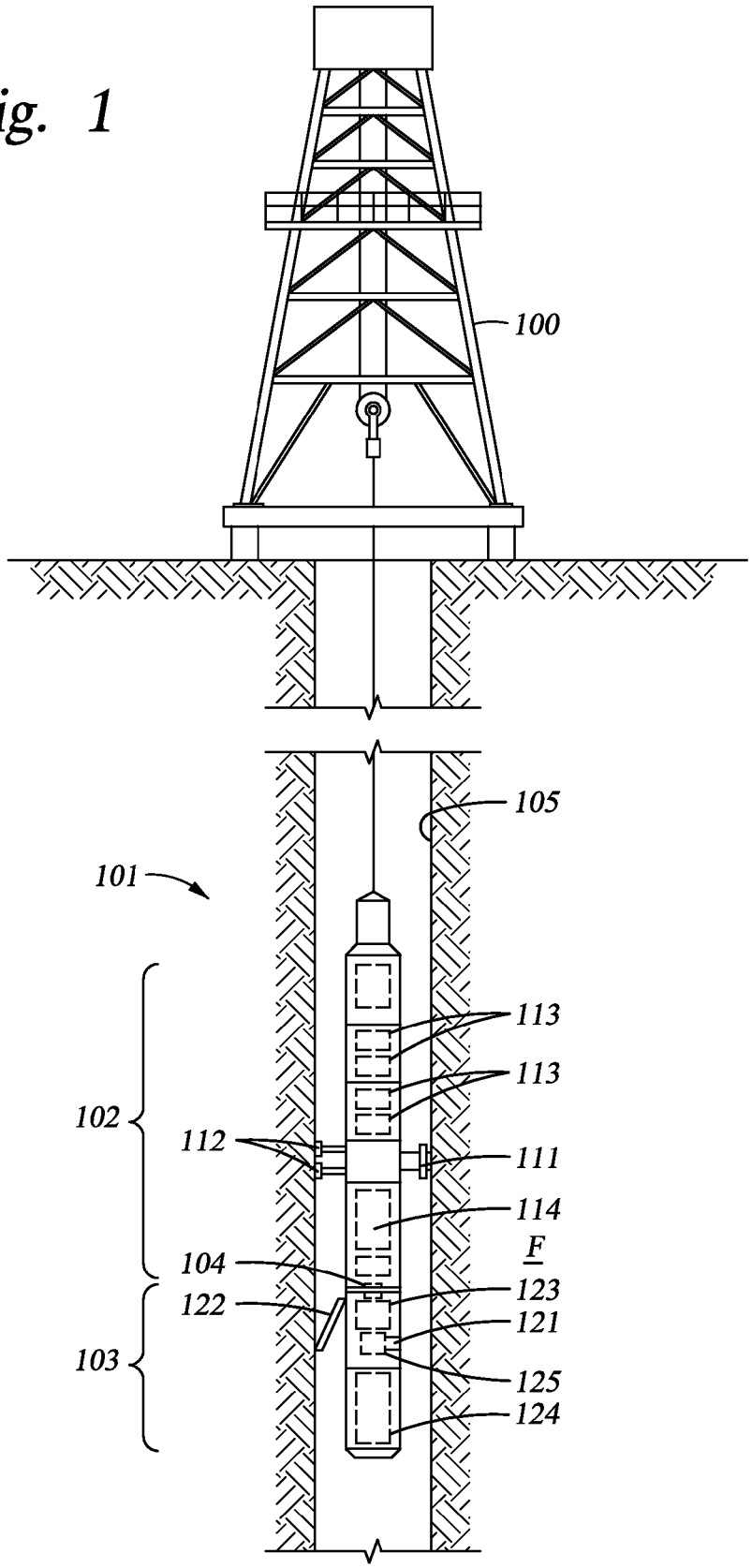
FIG. 1 is a schematic of a wireline assembly that includes a coring tool.

FIG. 1 shows a schematic illustration of a wireline apparatus 101 deployed into a wellbore 105 from a rig 100 in accordance with one embodiment of this disclosure. The wireline apparatus 101 includes a coring tool 103. The coring tool 103 is illustrated as having a coring assembly 125 that includes a coring bit assembly 120 having a coring bit 121. The coring tool 103 further includes a storage area 124 for storing core samples, and the associated actuation mechanisms 123. The storage area 124 is configured to receive sample cores, which may or may not include a sleeve, canister, or other holder. At least one brace arm 122 may be provided to stabilize the tool 101 in the borehole (not shown) when the coring bit 121 is functioning.

The wireline apparatus 101 may further include additional systems for performing other functions. One such additional system is illustrated in FIG. 1 as a formation testing tool 102 that is operatively connected to the coring tool 103 via field joint 104. The formation testing tool 102 may include a probe 111 that is extended from the formation testing tool 102 to be in fluid communication with a formation F. Back up pistons 112 may be included in the tool 101 to assist in pushing the probe 111 into contact with the sidewall of the wellbore and to stabilize the tool 102 in the borehole. The formation testing tool 102 shown in FIG. 1 also includes a pump 114 for pumping the sample fluid through the tool, as well as sample chambers 113 for storing fluid samples. The locations of these components are only schematically shown in FIG. 1, and may be provided in other locations within the tool than as illustrated. Other components may also be included, such as a power module, a hydraulic module, a fluid analyzer module, and other devices.

The apparatus of FIG. 1 is depicted as having multiple modules operatively connected together. The apparatus, however, may also be partially or completely unitary. For example, as shown in FIG. 1, the formation testing tool 102 may be unitary, with the coring tool housed in a separate module operatively connected by field joint 104. Alternatively, the coring tool may be unitarily included within the overall housing of the apparatus 101.

Downhole tools often include several modules (i.e., sections of the tool that perform different functions). Additionally, more than one downhole tool or component may be combined on the same wireline to accomplish multiple downhole tasks in the same wireline run. The modules are typically connected by "field joints," such as the field joint 104 of FIG. 1. For example, one module of a formation testing tool typically has one type of connector at its top end and a second type of connector at its bottom end. The top and bottom connectors are made to operatively mate with each other. By using modules and tools with similar arrangements of connectors, all of the modules and tools may be connected end to end to form the wireline assembly. A field joint may provide an electrical connection, a hydraulic connection, and a flowline connection, depending on the requirements of the tools on the wireline. An electrical connection typically provides both power and communication capabilities.

In practice, a wireline tool will generally include several different components, some of which may be comprised of two or more modules (e.g., a sample module and a pumpout module of a formation testing tool). In this disclosure, "module" is used to describe any of the separate tools or individual tool modules that may be connected in a wireline assembly. "Module" describes any part of the wireline assembly, whether the module is part of a larger tool or a separate tool by itself. It is also noted that the term "wireline tool" is sometimes used in the art to describe the entire wireline assembly, including all of the individual tools that make up the assembly. In this disclosure, the term "wireline assembly" is used to prevent any confusion with the individual tools that make up the wireline assembly (e.g., a coring tool, a formation testing tool, and an NMR tool may all be included in a single wireline assembly).

Figure 2:
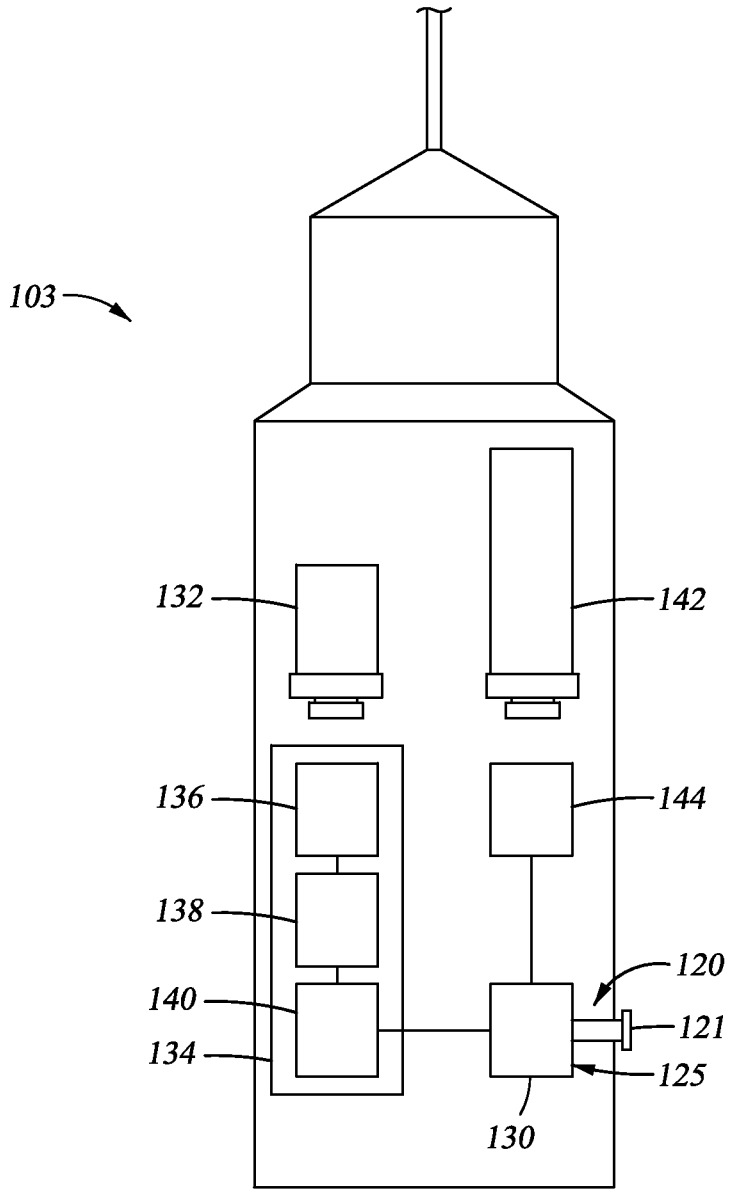
FIG. 2 is an enlarged schematic of the coring tool module of FIG. 1.

FIG. 2 is an enlarged schematic illustration of the actuation mechanisms of the coring tool 103. As noted above, the coring tool 103 includes the coring assembly 125 with the coring bit 121. A hydraulic coring motor 130 is operatively coupled to rotationally drive the coring bit 121 so that it may cut into the formation F and obtain a core sample.

In order to drive the coring bit 121 into the formation, it must be pressed into the formation while it is being rotated. Thus, the coring tool 103 applies a weight-on-bit ("WOB") (i.e., the force that presses the coring bit 121 into the formation) and a torque to the coring bit 121. FIG. 2 schematically depicts mechanisms for applying both of these forces. For example, the WOB may be generated by a motor 132, which may be an AC, brushless DC, or other power source, and a control assembly 134. The control assembly 134 may include a hydraulic pump 136, a feedback flow control ("FFC") valve 138, and a piston 140. The motor 132 supplies power to the hydraulic pump 136, while the flow of hydraulic fluid from the pump 136 is regulated by the FFC valve 138. The pressure of the hydraulic fluid drives the piston 140 to apply a WOB to the coring bit 121, as described in greater detail below.

The torque may be supplied by another motor 142, which may be an AC, brushless DC, or other power source, and a gear pump 144. The second motor 142 drives the gear pump 144, which supplies a flow of hydraulic fluid to the hydraulic coring motor 130. The hydraulic coring motor 130, in turn, imparts a torque to the coring bit 121 that causes the coring bit 121 to rotate.

While specific examples of the mechanisms for applying WOB and torque are provided above, any known mechanisms for generating such forces may be used without departing from the scope of this disclosure. Additional examples of mechanisms that may be used to apply WOB and torque are disclosed in U.S. Pat. Nos. 6,371,221 and 7,191,831, both of which are assigned to the assignee of the present application and are incorporated herein by reference.

The coring tool 103 is shown in greater detail in FIGS. 3-6. The coring tool 103 includes a tool housing 150 extending along a longitudinal axis 152. The tool housing 150 defines a coring aperture 154 through which core samples are retrieved. The coring assembly 125 and storage area 124 are disposed within the tool housing 150.

Figure 7A:
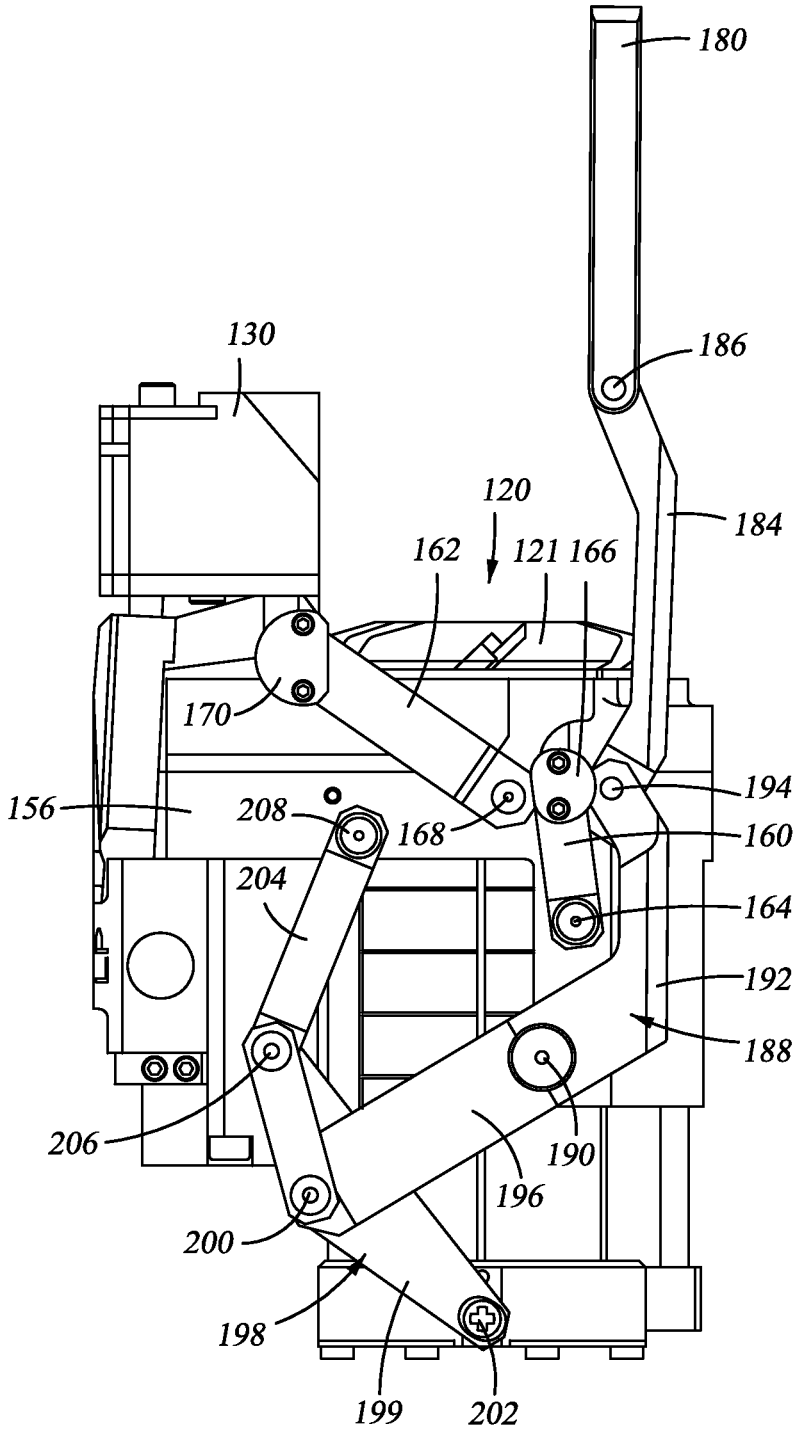
FIG. 7*a* is a side elevation view of a coring assembly used in the coring tool module of FIG. 1.
Figure 7B:
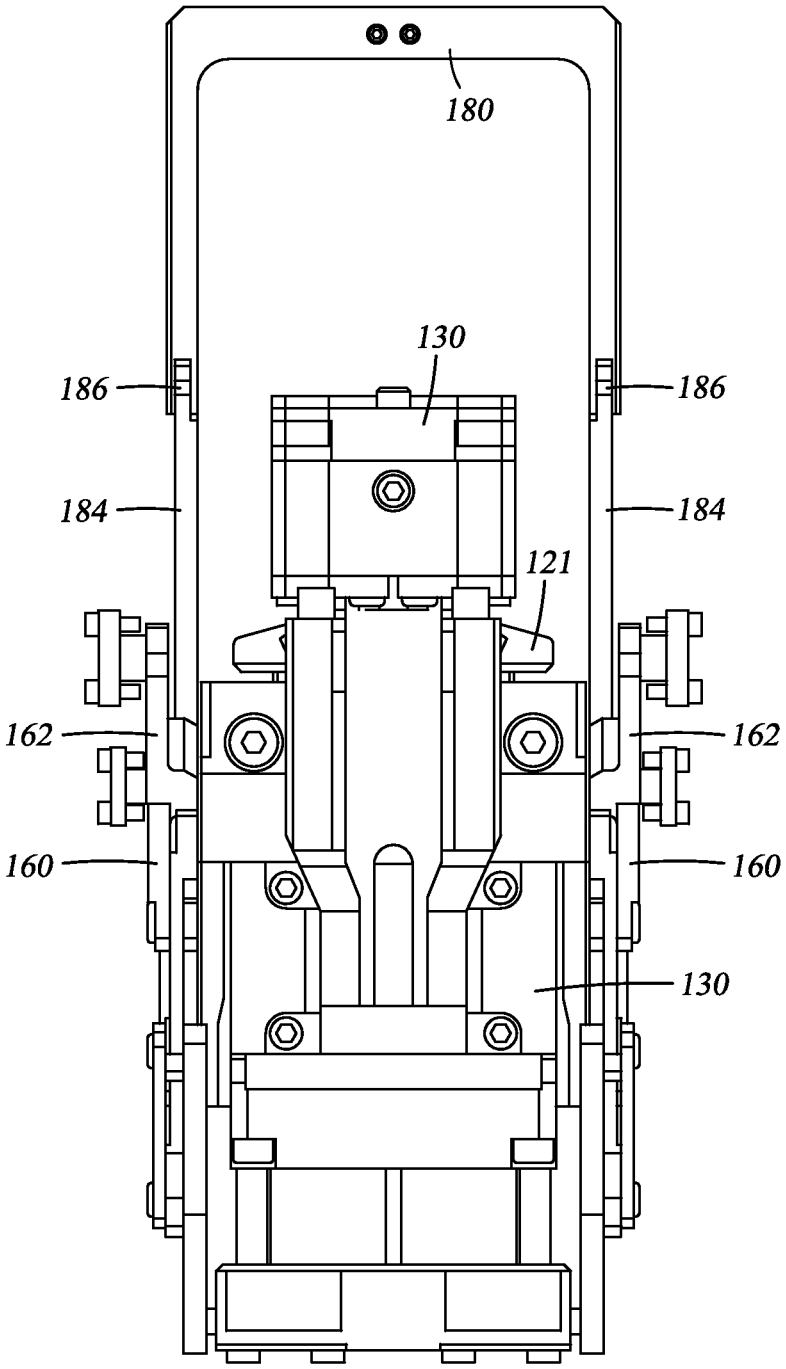
FIG. 7*b* is a plan view of the coring assembly shown in FIG. 7*a*.

The coring assembly 125 includes a bit housing 156 (as best shown in FIGS. 7*a* and 7*b*), which may be rotatably coupled to the tool housing 150. The coring bit 121 is mounted within the coring bit assembly 120 that is slideably disposed in the bit housing 156. The coring bit 121 is mounted in the coring bit assembly 120 such that it may rotate within the bit housing 156 and the coring bit assembly 120. Thus, the coring bit 121 may both slide axially and rotate within the bit housing 156. The coring motor 130 is also mounted on the bit housing 156 and is operably connected to the coring bit 121 to rotate the bit. While the coring motor 130 is illustrated herein as a hydraulic motor, it will be appreciated that any type of motor or mechanism capable of rotating the coring bit 121 may be used.

One or more rotation link arms are provided for rotatably mounting the bit housing 156 with respect to the tool housing 150. As best shown in FIGS. 7*a* and 7*b*, the coring assembly 125 includes a pair of first or upper rotation link arms 160 and a pair of second or lower rotation link arms 162. Each upper rotation link arm 160 includes a first end 164 pivotably coupled to the bit housing 156 and a second end 166 pivotably coupled to the tool housing 150. Similarly, each lower rotation link arm 162 includes a first end 168 pivotably coupled to the bit housing 156 and a second end 170 pivotably coupled to the tool housing 150. As used herein, the terms "pivotably coupled" or "pivotably connected" means a connection between two tool components that allows relative rotating or pivoting movement of one of the components with respect to the other component, but does not allow sliding or translational movement of the one component with respect to the other.

Figure 3:
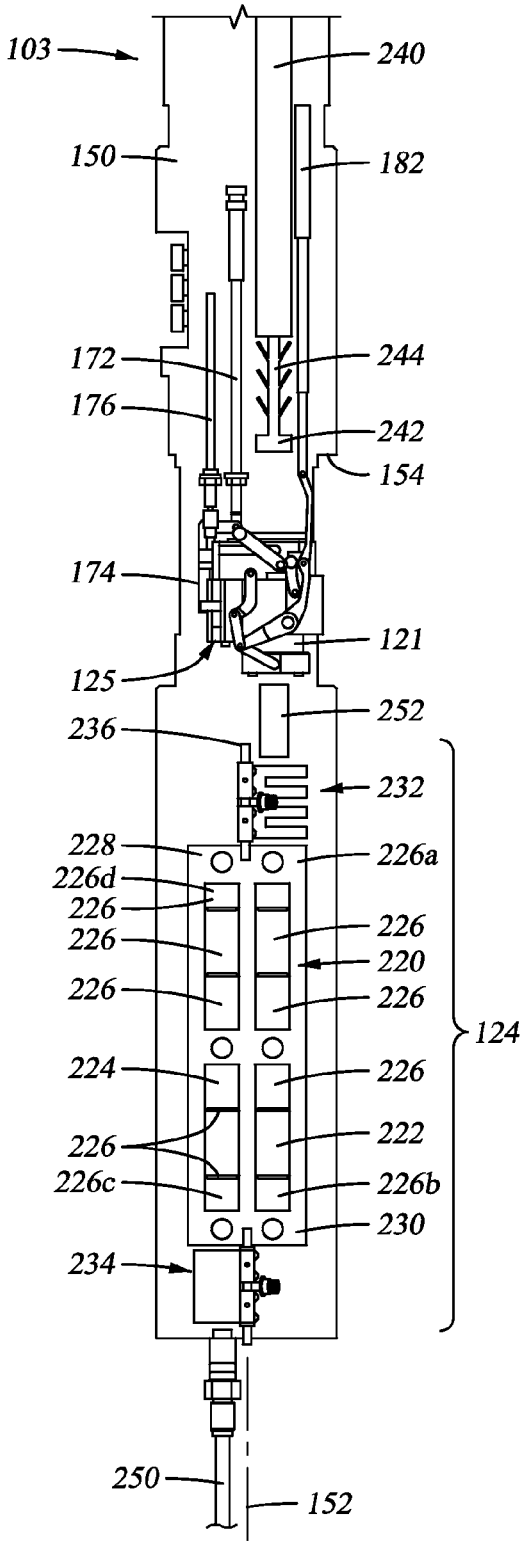
FIG. 3 is a schematic, in cross-section, of the coring tool module with a coring bit in the eject position.
Figure 4:
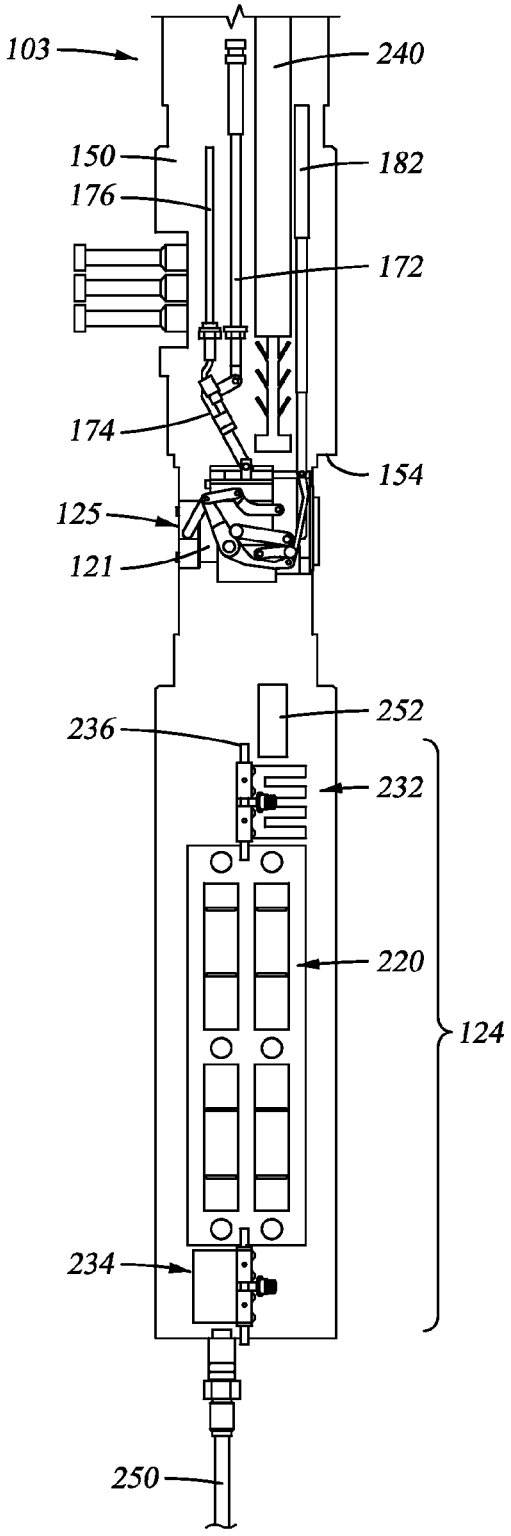
FIG. 4 is a schematic, in cross-section, of the coring tool module with the bit housing in a coring position and the coring bit retracted.

The rotation link arms 160, 162 are positioned and designed to allow the bit housing 156 to rotate with respect to the tool housing 150 from an eject position in which the coring bit 121 extends substantially parallel to the tool housing longitudinal axis 152, and a coring position in which the bit housing 156 is rotated so that the coring bit extends substantially perpendicular to the longitudinal axis 152 as illustrated in FIGS. 3 and 4, respectively. When the bit housing 156 is in the eject position, a core cavity of the coring bit 121 registers with the storage area 124. Conversely, when the bit housing 156 is in the coring position as shown in FIG. 4, the core cavity of the coring bit 121 registers with the coring aperture 154 formed in the tool housing 150. The term "register" is used herein to indicate that voids or spaces defined by two components (such as the core cavity of the coring bit 121 and the storage area 124 or coring aperture 154) are substantially aligned.

A first or rotation piston 172 is operably coupled to the bit housing 156 to rotate the bit housing 156 between the eject and coring positions. As shown in FIGS. 3-6, the rotation piston 172 is coupled to the bit housing 156 by an intermediate link arm 174. As the piston 172 moves from an extended position shown in FIG. 3 to a retracted position shown in FIG. 4, the bit housing 156 rotates about the rotation link arms 160, 162 from the eject position to the coring position. The intermediate link arm 174 may also provide convenient means for communicating hydraulic fluid from one or more hydraulic flow lines 176 to the coring motor 130.

A series of pivotably coupled extension link arms is coupled to a portion, such as the thrust ring, of the coring bit assembly 120 to provide a substantially constant WOB. As best shown in FIGS. 7*a* and 7*b*, the series of extension link arms includes a yoke 180 adapted for coupling to a second or extension piston 182 (FIGS. 3-6). A pair of followers 184 is pivotably coupled to the yoke 180 at pins 186. A pair of rocker arms 188 is pivotably mounted on the bit housing 156 for rotation about an associated pin 190. Each rocker arm 188 includes a first segment 192 that is pivotably coupled to an associated follower link arm 184 at pin 194 and a second segment 196. A scissor jack 198 is pivotably coupled to each rocker arm. More specifically, each scissor jack 198 includes a bit arm 199 pivotably coupled to the rocker arm second segment 196 at pin 200 and further pivotably coupled to the coring bit assembly 120 of the coring bit 121 at pin 202. Each scissor jack 198 further includes a housing arm 204 having a first end pivotably coupled to the bit arm 199 a pin 206 and a second end pivotably coupled to the bit housing 156 at pin 208. In the illustrated embodiment, the series of link arms includes the yoke 180, followers 184, rocker arms 188 and scissor jack 198. The series of extension link arms, however, may include additional or fewer components that are pivotably coupled to one another without departing from the scope of this disclosure and the appended claims.

Figure 5:
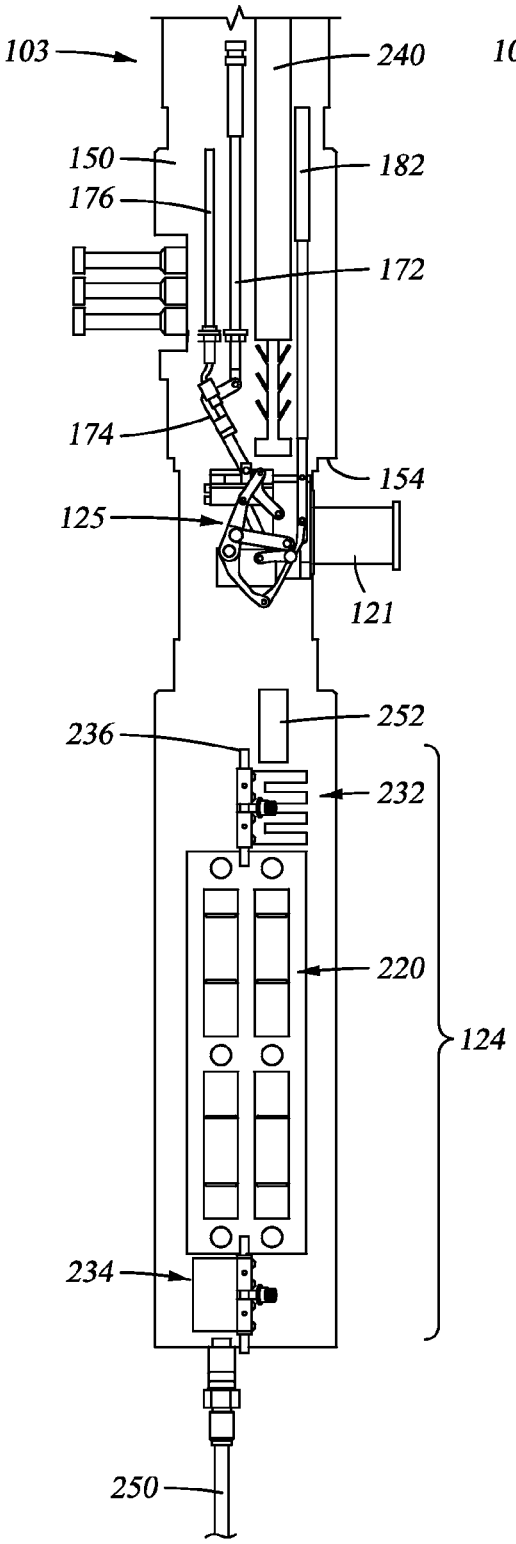
FIG. 5 is a schematic, in cross-section, of the coring tool module with the coring bit in an extended position.

With the series of extension link arms as shown, movement of the second piston 182 will actuate the coring bit assembly 120 and hence the coring bit 121 between a retracted position as shown in FIG. 4 and an extended position as shown in FIG. 5. The second piston 182 may begin in a retracted position as shown in FIG. 4. As the second piston 182 moves toward an extended position shown in FIG. 5, it pushes the yoke 180 and follower link arm 184 to rotate the rocker arm 188 in a clockwise direction as shown in FIG. 7*a*. When the rocker arm 188 rotates clockwise, it closes the scissor jack 198 thereby driving the coring bit assembly 120 to the extended position (or toward the left as shown in FIG. 7*a*). By locating the pins 202, 206 as shown in FIG. 7*a*, the scissor jacks 198 exert a mechanical advantage as the scissor jack 198 closes. More specifically, the amount of lost motion in the series of extension link arms is kept essentially constant as the scissor jacks close thereby to transfer an almost constant percentage of the piston force to the coring bit 121. As a result, the series of extension link arms produces a more constant WOB across the entire range of travel of the coring bit 121 and coring assembly 120.

From the foregoing, it will further be appreciated that extension of the coring bit 121 is substantially decoupled from the rotation of the bit housing 156. The first piston 172 and intermediate link arm 174 are independent from the second piston 182 and series of extension link arms used to extend the coring bit 121. Accordingly, the first and second pistons 172, 182 may be operated substantially independent of one another, which may allow for additional functionality of the coring tool 103. For example, and notwithstanding any clearance issues with the tool housing 150 or other tool structures, the coring bit 121 may be extended at any time regardless of the position of the bit housing 156. Consequently, core samples may be obtained along a diagonal plane when the bit housing 156 is held at an orientation somewhere between the eject and coring positions described above.

While the first and second pistons 172, 182 may be operated independently, operation of one of the pistons may impact or otherwise require cooperation of the other piston. During rotation of the bit housing 156, for example, the second piston 182 may be de-energized or controlled in a manner such as by dithering, to minimize any resistance the second piston 182 might exert against such rotation. The primary functions of the rotation link arms and the extension link arms, however, may be achieved independent of one another.

Figure 6:
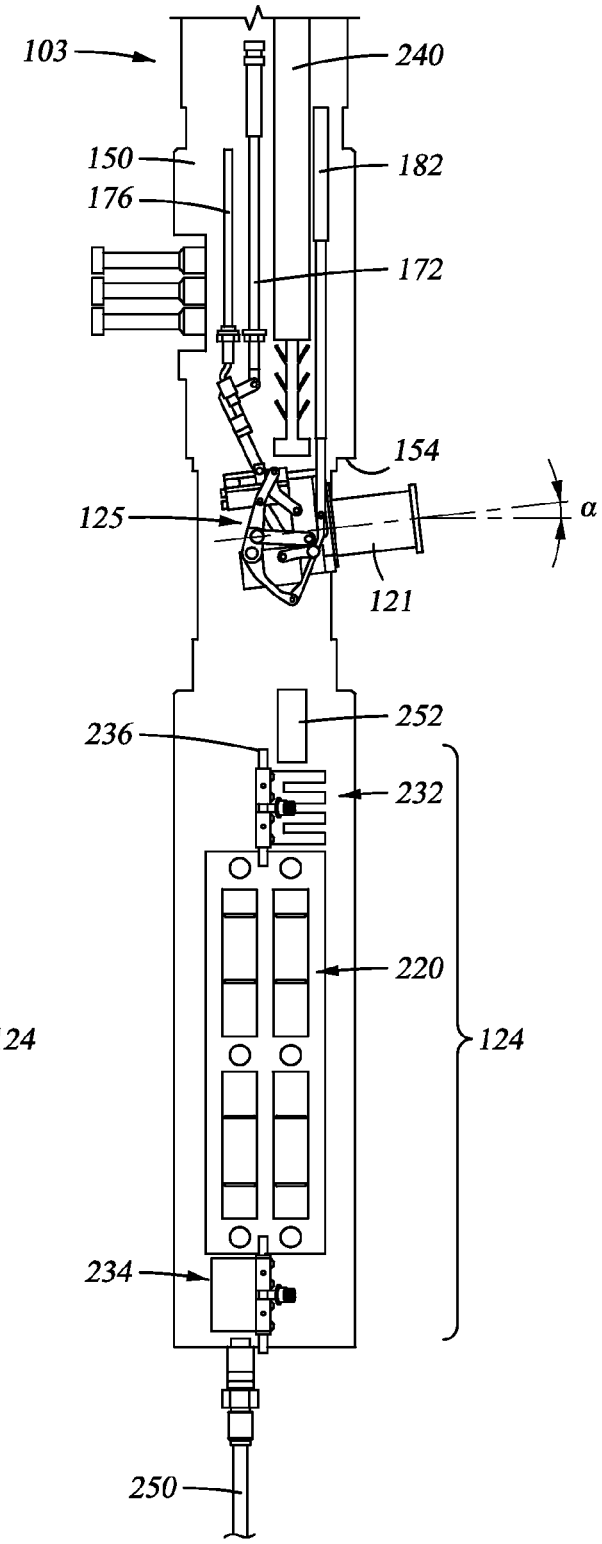
FIG. 6 is a schematic, in cross-section, of the bit housing in a sever position.

The rotation link arms 160, 162 may further permit additional rotation of the bit housing 156 to a sever position to assist with separating a core sample from the formation. When the coring bit 121 is fully extended so that cutting into the formation is complete, it is typically oriented substantially perpendicular to the longitudinal axis 152 as shown in FIG. 5. The core sample formed by the bit 121, however, may still remain securely attached to the formation. To assist with detaching the core sample, the bit housing 156 may further be rotated an additional amount to a sever position as shown in FIG. 6. It has been found that an additional angular rotation a of approximately 7 degrees is sufficient to sever the core sample from the formation. Often, the required additional angular rotation is less than 7 degrees, on the order of 0.25 to 2 degrees. The first and second rotation link arms 160, 162 may be advantageously positioned so that the additional rotation between the coring and severing positions occurs about a center of rotation that is substantially coincident with the distal cutting end of the coring bit 121.

The coring tool 103 further includes a system for efficiently handling and storing multiple core samples. Accordingly, the storage area 124 may include a core receptacle 220 having at least first and second storage columns 222, 224 each sized to receive core holders 226 adapted to hold core samples. In the illustrated embodiment, each storage column 222, 224 is shown holding six core holders 226, however, the columns may be sized to hold more or less than six core holders depending on the dimensions of the storage area 124. For example, each storage column may be sized to hold up to twenty five core holders 226. The core receptacle 220 defines a proximal end 228 positioned nearer to the bit housing 156 and a distal end 230 positioned farther from the housing 156.

Shifters 232, 234 may be provided to move core holders between the storage columns 222, 224. In the illustrated embodiment, the shifter 232 is coupled to the core receptacle proximal end 228 and includes fingers adapted to grip an exterior of a core holder 226. The shifter 232 is mounted on a spindle 236 and may rotate from a first position in which the shifter 232 registers with a proximal end of the first storage column 222, to a second position in which the shifter registers with a proximal end of the second storage column 224. The other shifter 234 is coupled to the core receptacle distal end 230 and is similarly rotatable between a first position in which the shifter 234 registers with a distal end of the first storage column 222 and second position in which it registers with a distal end of the second storage column 224.

A first transporter is provided for transferring an empty core holder from the proximal shifter 232 up to and into the coring bit 121 as it moves from the extended position to a retracted position. In the illustrated embodiment, the first transporter comprises a handling piston 240, such as a ball screw piston, which is positioned coaxially with respect to the receptacle first storage column 222 and is further coaxial with the coring bit 121 when the bit housing 156 is in the eject position. A core transfer tube 252 may extend between the coring bit 121 and the proximal shifter 232 to facilitate transfer of a core holder there between. The handling piston 240 includes a gripper, such as gripper brush 244, adapted to engage an interior surface of a core holder side wall. Accordingly, the handling piston 240 may extend into and through the coring bit 121 as it moves to its extended position. The gripper brush 244 provided on the end of the handling piston 240 may hold the core holder as it is transferred from the proximal shifter 232 to the coring bit 121.

Figure 8:
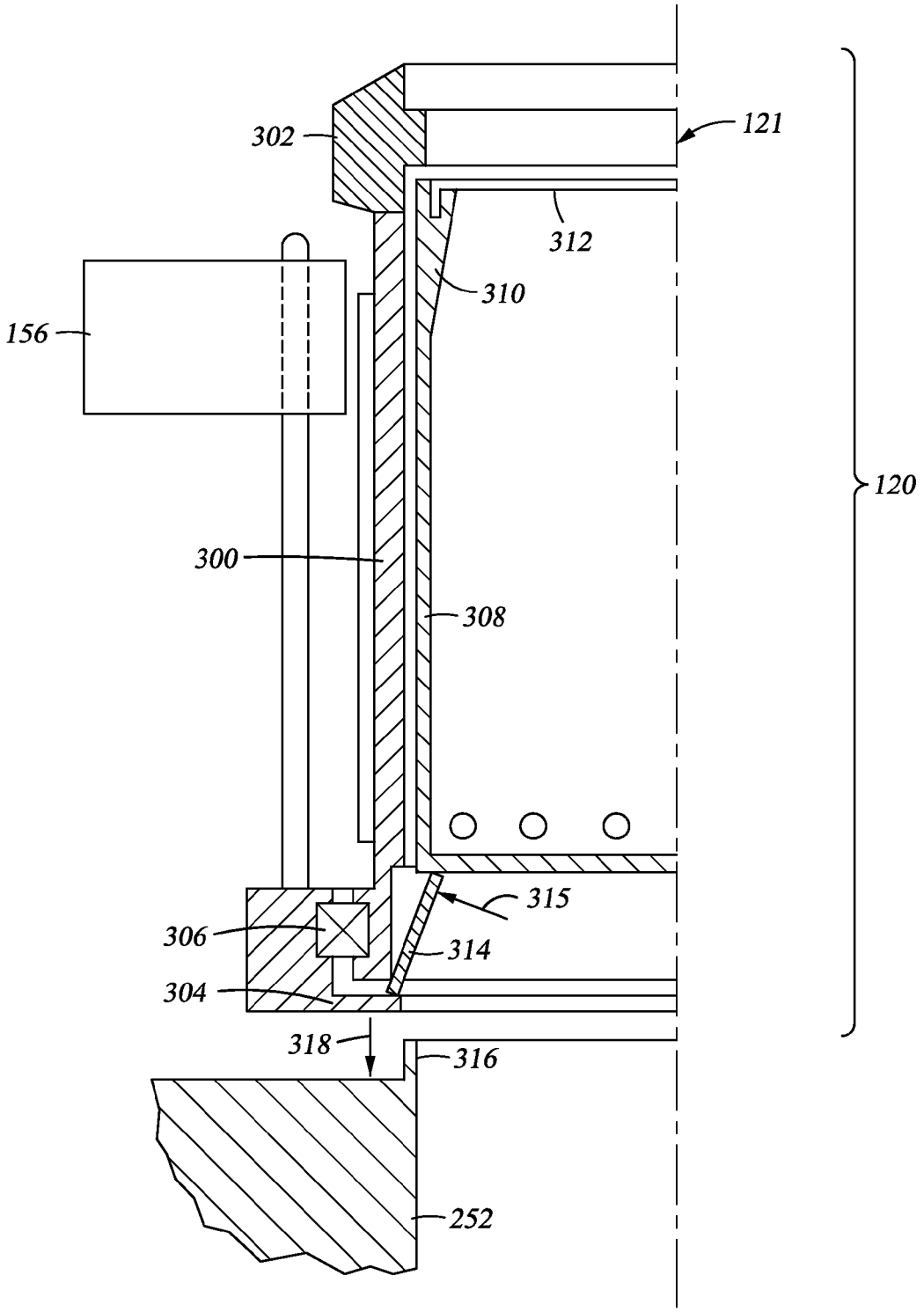
FIG. 8 is a partial side elevation view, in cross-section, of a coring bit.

The coring bit 121 may be configured to retain a core sample and/or core holder within the bit until it is to be discharged. In the embodiment illustrated in FIG. 8. The coring bit 121 includes a coring shaft 300 carrying a cutting element 302 on its distal end. The coring shaft 300 is coupled to a thrust ring 304 by a thrust bearing 306. The thrust ring 304, in turn, is coupled to the coring housing 156. A core holder 308 is disposed inside the coring shaft 300 and includes a core gripper, such as one or more protrusions 310. Additional details regarding the protrusions 310, as well as alternatives thereto, are disclosed in greater detail in U.S. Patent Application Publication No. 2004/0140126 A1 in the name of Hill, et al., which is incorporated herein by reference. A retention member 312 may be coupled to a distal end of the core holder 308 which permits core travel in a first direction into the core holder 308 but prevents core travel in a reverse direction, thereby retaining the core within the core holder 308. Exemplary retention members are disclosed in U.S. Patent Application Publication No. 2005/0133267 A1 in the name of Reid, Jr., et al., which is also incorporated herein by reference. One or more proximal end retainer, such as retaining arm 314, is provided to prevent the core holder 308 from traveling in the proximal direction. The retaining arm 314 has a normal position as shown in FIG. 8 in which the arm 314 extends inwardly to obstruct travel of the core holder in the proximal direction. The arm 314 may be selectively deflected out of the travel path in the direction of arrow 315 to a retracted position (not shown) to permit the core holder 308 to move in the proximal direction. The transfer tube 252 may include an actuating tab 316 sized to engage and move the arm 314 to the retracted position. Thus, according to the illustrated embodiment, the retaining arm 314 will automatically move to the retracted position when the coring bit 121 is moved in the direction of arrow 318 toward the transfer tube 252, thereby permitting the core holder 308 to be advanced to the storage area 124 via the transfer tube 252.

The handling piston 240 may also advance a core holder from the coring bit 121 to the proximal shifter 232 and/or to the proximal end of the first storage column 222. In the illustrated embodiment, the handling piston 240 may include a foot 242 sized to engage a majority of the cross-sectional area of a core sample or an outer diameter of the core holder. The handling piston 240 may be actuated to an extended position in which it passes through the bit and/or through the proximal shifter 232 and partially into the proximal end of the first storage column 222, thereby transporting a core holder from the coring bit 121 to the proximal shifter 232 and/or to the first storage column 222. A core holder disposed inside the coring bit 121 and holding a recently obtained core sample may thus be transferred from the coring bit 121 to the proximal shifter 232 and/or the first storage column by the handling piston 240.

In another embodiment (not shown), the handling piston 240 transfers an empty core holder from the proximal shifter 232 up to and into the transfer tube 252, where it may be secured. A collet or other retention device (not shown) may be disposed inside the transfer tube 252 to strip the core holder from the handling piston 240. In this embodiment, the handling piston 240 may also advance a core from the coring bit 121 to the core holder secured in the transfer tube 252. The handling piston may further transfer the core holder disposed inside the transfer tube 252 and holding a recently obtained core sample from the transfer tube 252 to the proximal shifter 232 and/or the first storage column by the handling piston 240. Since in this embodiment no core holder is provided in the coring bit 121, the coring bit preferably include a non rotating core holder for receiving the core.

A second transporter, such as lift piston 250, may be provided to advance a core holder 226 from the distal shifter 234 to the second storage column 224. As shown in FIGS. 3-6, the lift piston 250 is coaxial with the second storage column 224 and adapted to move from a retracted position to an extended position in which it passes through the distal shifter 234 and partially into the second storage chamber 224. As it moves to the extended position, the lift piston 250 will transport a core holder disposed inside the distal shifter 234 into the distal end of the second storage column 224.

In operation, the handling assembly may be used to transfer core holders between the storage area 124 and the coring bit 121 and store core holders in multiple adjacent storage columns. Prior to obtaining a first core sample, the first and second storage columns 222, 224 of the receptacle 220 may be filled with empty core holders. These would include a first core holder 226*a* positioned at a proximal end of the first storage column 222 and a second core holder 226*b* positioned at a distal end of the first storage column 222. In addition, a third core holder 226*c* is positioned at a distal end of the second storage column 224 and a fourth core holder 226*d* is positioned at a proximal end of the second storage column 224. An additional empty core holder is disposed inside the coring bit 121 and is adapted to receive the first core to be formed.

The coring bit 121 may be operated to obtain a core sample in the current core holder stored therein, and the bit housing 156 may be returned to the eject position. The handling piston 240 may then be extended so that the foot 242 engages the current core disposed in the coring bit 121. Further extension of the handling piston 240 transports the current core holder from the coring bit 121 to the receptacle 220 so that the current core holder is adjacent the proximal end of the first storage column 222. Still further extension of the handling piston 240 will insert the current core holder in the first storage column proximal end so that it engages with the first core holder 226*a*, thereby advancing the first series of stacked core holders in the distal direction in the first storage column 222 to eject the second core holder 226*b* from a distal end thereof. The distal shifter 234 may be positioned to register with the first storage column, thereby to receive the ejected core holder 226*b*.

A proximal shifter 234 may then be rotated to register with the second storage column 224 and the lift piston 250 may be extended to insert the second core holder 226*b* into the second storage column distal end. As the second core holder 226*b* is inserted into the second storage column 224, the entire second series of stacked core holders is advanced in a proximal direction along the second storage column 224 thereby ejecting the fourth core holder 226*d* from the proximal end of the second storage column 224. The proximal shifter 232 may be positioned to register with the second storage column 224, thereby to receive the ejected fourth core holder 226*d*. By this time, the handling piston 240 may be at least partially retracted so that it is clear of the proximal shifter 232. The proximal shifter 232 may then rotate to register with the first storage column 222, thereby transferring the fourth core holder 226*d* to be positioned adjacent the proximal end of the first storage column 222.

The handling piston 240 may again be extended until the gripper 244 engages the fourth core holder 226*d*. The handling piston 240 may then be retracted to transfer the fourth core holder 226*d* from the receptacle 220 to the coring bit 121. The fourth core holder 226*d* is stripped from the handling piston as it retracts through the coring bit 121, thereby to remain inside the coring bit to receive the next core sample. The above steps may then be repeated until each core holder contains a core sample. The core holders with core samples are stored in order inside the receptacle 220, with the oldest or first sample ultimately being located at the proximal end of the second storage column 224 and the last or most recent core sample being located at the proximal end of the first storage column 222. While one method of handling and storing cores is illustrated and described herein, it will be appreciated that additional methods of handling/storing cores may be used without departing from the scope of this disclosure.

The coring tool 103 may include one or more sensors for detecting the presence and/or geophysical properties of sample cores obtained from the formation. For example, the tool 103 may include a geophysical-property measuring unit that is connected by the tool bus to a telemetry unit, thereby to transmit data to a data acquisition and processing apparatus located at the surface. The geophysical-property measuring unit may be a gamma-ray detection unit, NMR sensors, electromagnetic sensor, or other device. Additional details regarding the geophysical-property measuring unit are provided in U.S. Patent Application Publication No. 2007/0137894 in the name of Fujisawa et al., which is incorporated herein by reference.

The coring tool 103 disclosed herein also permits measuring the lengths of the core samples obtained from the formation. In an exemplary embodiment, the length of a core sample may be obtained during normal core holder handling, core retrieving, and core storage operations. When using canisters as the core holders, for example, a baseline or first position of the handling piston may be obtained when the piston 240 engages an empty core holder positioned in the proximal shifter 232. The handling piston 240 may then be retracted upwardly until the canister is positioned within the coring bit 121. The coring bit 121 is then rotated to the coring position and operated to retrieve a core, as described above. Subsequently, the coring bit 121 is rotated back to the eject position and the handling piston 240 may then be extended to eject the canister and core sample from the bit. The handling piston 240 continues to extend until the canister with core sample is disposed within the proximal shifter 232, at which time a second position of the handling piston may be obtained. The length of the core may then be determined from the difference between the first (or baseline) and second positions. The core length may then be transmitted and displayed as desired. While the exemplary embodiment uses specific locations of the piston during operation to determine core length, other locations of the piston, or obtaining the locations of other components of the tool during operation, may be used to determine core length.

The tool may detect when the handling piston 240 is in the first and second positions by detecting relative increases in resistance experienced by the piston. For both the first and second positions, a collet or other mechanical means may restrict further advancement of the canister, which will increase the load on the piston 240. The first and second positions may therefore be determined by monitoring the current draw on the piston motor for spikes. In one embodiment, the handling piston 240 may be provided as a ball screw piston coupled to a motor having a revolver, in which case the first and second distances may be determined from the number of motor turns required to position the piston. The method may further include taking a second core if the first core length is lower than a predetermined threshold, in which case the length of the second core may be determined in a similar fashion. While the foregoing embodiment monitors motor current draw to identify the first and second piston positions, other means, such as position sensors, may be used to determine when the piston is in the first and second positions.

According to additional aspects of the present disclosure, the coring tool 103 is capable of obtaining core samples having relatively large lengths and diameters relative to the nominal diameter of the borehole. Many boreholes are formed with a nominal diameter of approximately 6.5 to 17.5 inches. As a result, the overall diameter of the downhole tool is limited, which also limits the size and diameter of the core samples that can be obtained from the formation. The foregoing coring tool 103 may be provided with an overall diameter of less than approximately 5.25 inches. By using a free-standing coring bit support such as the above-described extension linkage, as opposed to sliding guide plates, the stroke length of the bit may be maximized for a given tool diameter. For example, the coring bit may be extended into the formation by a distance of at least approximately 2.25 inches and more preferably up to approximately 3.0 inches in a tool having an overall diameter of less than approximately 5.25 inches. The coring bit 121 may be provided with an inner diameter of at least approximately 1.0 inches, and more preferably approximately 1.5 inches. Additionally, by improving motor efficiency in the downhole tool or providing more electrical power to the downhole tool, larger diameter core samples, e.g. core samples having a diameter of approximately 2.0 inches, may be obtained.

A large volume core may be used to advantage for evaluating the reservoir. For example, one of the tests performed on sample core is a flow test. This test may provide porosity and permeability values of the formation rock from which the core has been captured. These values are often used together with other formation evaluation data to estimate the amount of hydrocarbon that can potentially be produced from a particular well. It should be appreciated however that the accuracy of the flow test result is usually sensitive to the volume of the sample. Thus, the core samples provided by the sidewall coring tool 103, and having a length up to approximately 3.0 inches (an increase greater than 50 percent over the cores provided by the sidewall coring tools of the prior art) have an increased testable volume after the ends of the core samples are trimmed. By doing so, the results of the analysis performed on the core samples may be more accurate, thereby providing better estimate of the hydrocarbon reserves.

Additionally, providing a core sample having a diameter of approximately 1.5 inches (an increase of about 50 percent over the cores provided by the sidewall coring tools of the prior art) further increases the core volume by 125 percent. Also, laboratory equipments are usually designed for 1.5 and 2.0 inches cores, and more rarely for 1.0 inch cores. Cores provided by the sidewall coring tools of the prior art are presently wrapped to fit into tester designed for larger cores. In contrast, cores provided by the sidewall coring tool 103 may be tested in readily available equipment.

While the foregoing apparatus and methods are described herein in the context of a wireline tool, they are also applicable to while drilling tools. It may be desirable to take core samples using MWD or LWD tools, and therefore the methods and apparatus described above may be easily adapted for use with such tools. Certain aspects of this disclosure may also be used in different coring applications, such as in-line coring.

While only certain embodiments have been set forth, alternatives and modifications will be apparent from the above description to those skilled in the art. These and other alternatives are considered equivalents and within the spirit and scope of this disclosure and the appended claims.

What is claimed:

1. A method comprising:

moving a handling piston of a coring tool from a first position to a second position with respect to the coring tool, the handling piston moving through a coring bit to the second position;

measuring the distance of the movement of the handling piston between the first position and the second position to determine a core length;

comparing the measured distance with a predetermined threshold; and operating a coring bit of the coring tool to obtain a core sample in response to determining that the measured distance is less than the predetermined threshold.

2. The method of claim 1, comprising moving the handling piston to engage an empty core holder to place the handling piston in the first position.

3. The method of claim 1, wherein measuring the distance comprising detecting increases in resistance experienced by the handling piston.

4. The method of claim 1, wherein measuring the distance comprises detecting spikes in current draw for a motor of the handling piston.

5. The method of claim 1, wherein measuring the distance comprises determining a number of motor turns for the first position, the second position, or both.

6. The method of claim 1, wherein the moving the handling piston of the coring tool comprises:

moving the handling piston from the first position with respect to the coring tool;

measuring pressure upon the handling piston with a pressure sensor; and stopping movement of the handling piston when the measured pressure upon the handling piston is more than a predetermined pressure;

wherein the handling piston stops in movement at the second position with respect to the coring tool.

7. The method of claim 1, wherein moving the handling piston comprises moving the handling piston through the coring bit to eject a coring sample holder from the coring bit.

8. The method of claim 1, wherein moving the handling piston comprises moving the handling piston through the coring bit to a transfer tube.

9. The method of claim 1, wherein moving the handling piston comprises moving the handling piston at least partially through the coring bit to be disposed on a surface of the coring sample.

10. The method of claim 1, wherein operating the coring bit comprises drilling into a wall of the borehole with the coring bit of the coring tool.

11. A method comprising:

extending a handling piston of a coring tool to a first position to engage a core holder;

retracting the handling piston to dispose the core holder within a coring bit of the coring tool;

operating the coring bit to obtain a first core sample;

extending the handling piston of the coring tool to a second position to eject the core holder from the coring bit;

measuring the distance of the movement of the handling piston between the first position and the second position to determine a core length;

comparing the measured distance with a predetermined threshold; and operating a coring bit of the coring tool to obtain a second core sample in response to determining that the measured distance is less than the predetermined threshold.

12. The method of claim 11, wherein extending the handling piston to the first position comprises extending the handling piston towards a proximal shifter holding the core holder.

13. The method of claim 12, wherein extending the handling piston to the second position comprises extending the handling position through the coring bit to dispose the core holder within the proximal shifter.

14. The method of claim 11, wherein operating the coring bit comprises rotating the coring bit from an eject position to a coring position.

15. The method of claim 11, comprising displaying the measured distance.

16. A method comprising:

drilling into a wall of the borehole with a coring bit of the coring tool, the coring bit disposed in a coring position with respect to the coring tool and the coring tool having an axis extending therethrough;

rotating the coring bit from the coring position to an ejection position with respect to the coring tool;

extending a handling piston of the coring tool from a retracted position to an extended position with respect to the coring tool;

measuring a distance of the movement of the handling piston between the retracted position and the extended position to determine a core length;

comparing the measured distance with a predetermined threshold; and operating a coring bit of the coring tool to obtain a core sample in response to determining that the measured distance is less than the predetermined threshold.

17. The method of claim 16, wherein measuring a distance comprises measuring the distance using a rotational position sensor coupled to an electric motor of the coring tool.

18. The method of claim 16, comprising moving the handling piston of the coring tool from the retracted position to an intermediate position to eject the coring sample holder from the coring bit.

19. The method of claim 16, wherein extending the handling piston from the retracted position to the extended position comprises actuating by a motor coupled to a ball screw, and wherein measuring the first and second distances comprises counting a number of turns of the motor.

20. The method of claim 16, wherein operating a coring bit comprises re-drilling into the wall of the borehole with the coring bit of the coring tool.

* * * * *